US006074029A

United States Patent [19]

Snoke et al.

[11] Patent Number: 6,074,029

[45] Date of Patent: Jun. 13, 2000

[54] WORKSTATION AND METHOD OF CONSTRUCTING THE SAME

[75] Inventors: Steven R. Snoke, Batavia; James D. Stewart, Hamilton, both of Ohio

[73] Assignee: The Stanley Works, New Britain, Conn.

[21] Appl. No.: 08/974,720

[22] Filed: Nov. 19, 1997

[51] Int. Cl.[7] ..... A47B 46/00

[52] U.S. Cl. ..... 312/249.11; 312/263; 312/265.5

[58] Field of Search ..... 312/257.1, 263, 312/265.5, 265.6, 249.8, 249.11

[56] References Cited

U.S. PATENT DOCUMENTS

| | | | |
|---|---|---|---|
| 4,274,547 | 6/1981 | Takagi et al. | 312/265.5 X |
| 4,595,105 | 6/1986 | Gold | 312/263 X |
| 4,782,873 | 11/1988 | Messner et al. | 312/249.11 X |
| 4,848,859 | 7/1989 | Edmonds et al. | 312/249.8 X |
| 5,246,286 | 9/1993 | Huebschen et al. | 312/263 |
| 5,533,799 | 7/1996 | Nickoluas, Jr. | 312/249.8 X |
| 5,580,137 | 12/1996 | Doan et al. | 312/257.1 |
| 5,642,923 | 7/1997 | Meacham et al. | 312/263 X |
| 5,645,332 | 7/1997 | Snoke et al. | 312/265.5 X |
| 5,738,423 | 4/1998 | Alfaro | 312/249.11 X |

*Primary Examiner*—Milton Nelson, Jr.
*Assistant Examiner*—Stephen Vu
*Attorney, Agent, or Firm*—Standley & Gilcrest LLP

[57] ABSTRACT

A modular workstation having a first module element having a plurality of grooves, a back panel and a side panel portion; a second module element having a plurality of grooves corresponding to the grooves of the first module element, a back panel, and a side panel portion; a plurality of rails inserted into the plurality of grooves of the first and second module elements; a top panel secured to the back panels and side panel portions of the first and second module elements; at least one upright attached to a base portion formed by the connected first and second module elements, a plurality of drawers, and a device for holding the plurality of drawers attached in predetermined positions on the uprights and side panel portions of the first and second module elements. Where uprights may be removed and added in predetermined slots for creating alternative drawer arrangements.

3 Claims, 8 Drawing Sheets

NO UPRIGHTS

ONE TALL UPRIGHT – LEFT

ONE TALL UPRIGHT – RIGHT

ONE SHORT UPRIGHT – LEFT

ONE SHORT UPRIGHT – RIGHT

TWO TALL UPRIGHTS

THREE TALL UPRIGHTS

TWO SHORT UPRIGHTS

THREE SHORT UPRIGHTS

TALL UPRIGHT LEFT SHORT UPRIGHT – RIGHT

TALL UPRIGHT RIGHT SHORT UPRIGHT – LEFT

TALL UPRIGHT LEFT AND CENTER; SHORT UPRIGHT – RIGHT

TALL UPRIGHT RIGHT AND CENTER; SHORT UPRIGHT – LEFT

TALL UPRIGHT LEFT AND RIGHT; SHORT UPRIGHT – CENTER

SHORT UPRIGHT LEFT AND CENTER; TALL UPRIGHT – RIGHT

SHORT UPRIGHT RIGHT AND CENTER; TALL UPRIGHT – LEFT

SHORT UPRIGHT LEFT AND RIGHT; TALL UPRIGHT – CENTER

WORKSTATION AND METHOD OF CONSTRUCTING THE SAME

BACKGROUND AND SUMMARY OF THE INVENTION

The present invention relates to the field of tool workstations, and more particularly, to a high weight capacity modular workstation and method of making the same.

Portable tool chests are known in the art (e.g. U.S. Pat. Nos. 5,549,377 and 5 4,938,548). However, there is a need for a heavy-duty, large capacity, workstation that can handle the weight of large storage loads. Conventional welded cabinet constructions at widths exceeding 60 inches have failed to support such large storage loads. Additionally, due to manufacturing cost of these workstations, it is desirable to have a workstation that is easily configurable to different sizes and drawer arrangements to meet unique user requirements. Such a workstation provides flexible storage options not available from known workstations.

Accordingly, the present invention provides many advantages over known workstations. The present invention:

1.) has a modular design allowing for the construction of different size units;

2.) is designed for high weight capacity storage (overall and in the individual drawers);

3.) is designed for large capacity storage (in excess of 13,000 square inches);

4.) is adaptable for custom drawer configurations;

5.) is designed so that once assembled the unit exhibits the appearance of a single piece construction; and 6.) is adapted with a keyless entry feature.

The present invention is preferably comprised of:

a first module element having a plurality of grooves, a back panel, a side panel portion, and a base; a second module element having a plurality of grooves corresponding to the grooves of the first module element, a back panel, a side panel portion, and a base; a plurality of rails inserted into the plurality of grooves of the first and second module elements; a top panel secured to the back panels and side panel portions of the first and second module elements; at least one upright attached to a base portion formed by the connected first and second module elements; a plurality of drawers; and means for holding the plurality of drawers attached in predetermined positions on the upright and side panel portions of the first and second module elements. Where uprights may be removed and added in predetermined slots for creating alternative drawer arrangements.

In addition to the features mentioned above, objects and advantages of the present invention will be readily apparent upon a reading of the following description.

BRIEF DESCRIPTION OF THF DRAWINGS

Novel features and advantages of the present invention, in addition to those mentioned above, will become apparent to those skilled in the art from a reading of the following detailed description in conjunction with the accompanying drawings wherein similar reference characters refer to similar parts and in which.

DETAILED DESCRIPTION OF PREFERRED EMBODIMENT(S)

The preferred system herein described is not intended to be exhaustive or to limit the invention to the precise forms disclosed. They are chosen and described to explain the principles of the invention, and the application of the method to practical uses, so that others skilled in the art may practice the invention.

Figure 1:
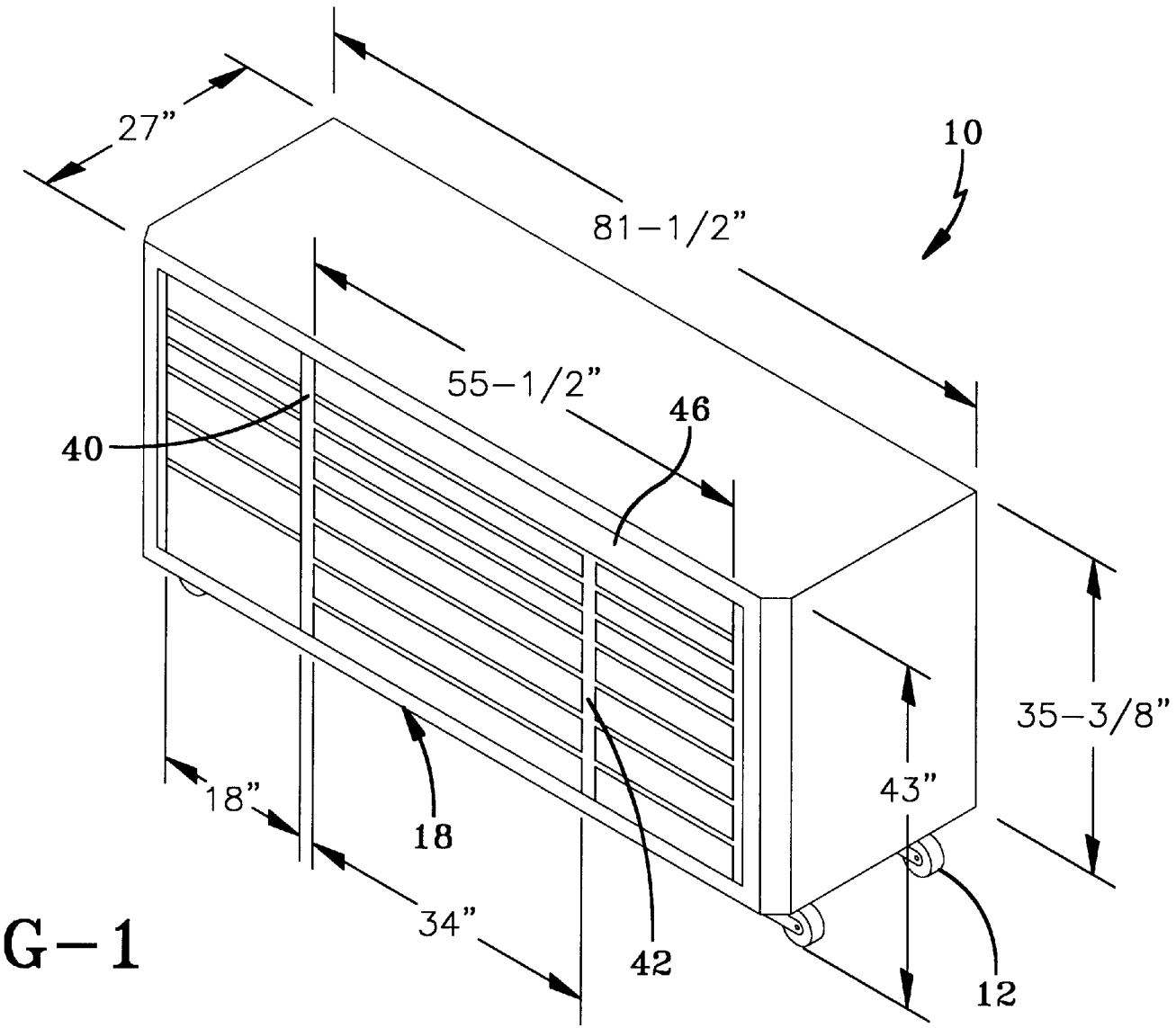
FIG. 1 illustrates one embodiment of an assembled workstation of the present invention.

FIG. 1 illustrates one embodiment of an assembled workstation 10 of the present invention. The workstation 10 of the present invention is a heavy-duty workstation capable of storing large loads and having the flexibility to be custom built for different user specifications. Although the preferred embodiment of the workstation is of a modular construction, as illustrated in FIG. 1, the design and construction of the workstation 10 is such that the workstation 10 is perceived as a one-piece construction.

In the preferred embodiment, the workstation 10 resides on spring casters 12. The casters 12 provide portability to the workstation 10. The casters 12 are designed to support the large loads the workstation 10 is capable of storing.

The workstation 10 illustrated in FIG. 1 depicts a workstation 10 having a first and second upright 40, 42 positioned in predetermined positions along the base portion 18 of the workstation 10. As will be discussed in greater detail below, the uprights 40, 42 may be arranged in various arrangements along the base portion 18 to allow for different drawer arrangements. A third upright (not shown in FIG. 1, see FIGS. 5A–5Q) may also be used in conjunction with the first and second uprights 40, 42 to provide four banks of drawers across the workstation 10.

Example dimensions have been indicated on FIG. 1. In another embodiment of the workstation 10 shown in FIG. 1, the width of the workstation 10 is 88¼", the height of the unit is 38½" (46⅜" including the casters 12), and the depth of the unit is 27". In this embodiment, the width of the top large drawer is 60 9/16" and the width of the middle bank of drawers is 38 15/16".

Figure 2:
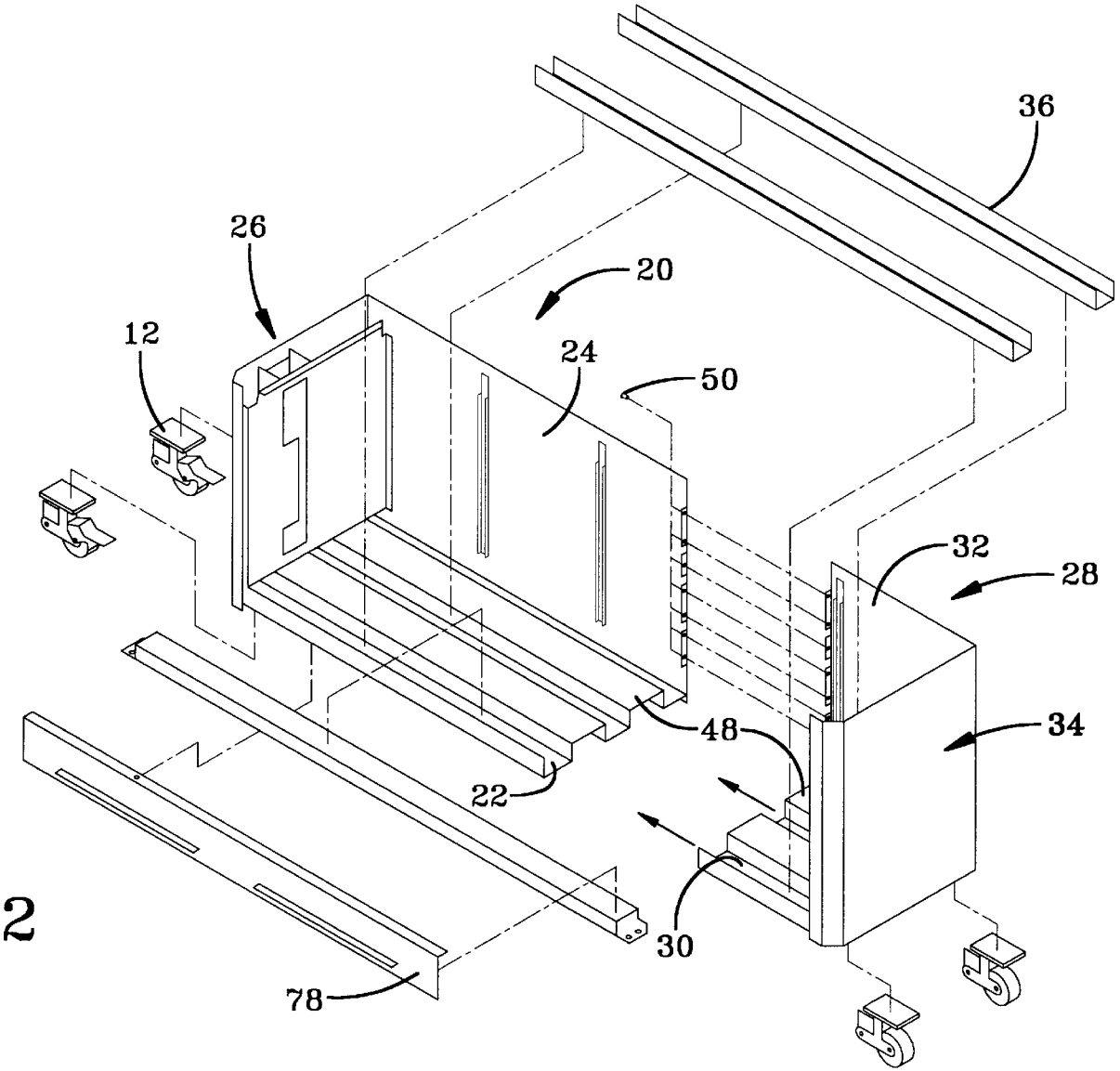
FIG. 2 illustrates an exploded view of one embodiment of the workstation of the present invention.
Figure 3:
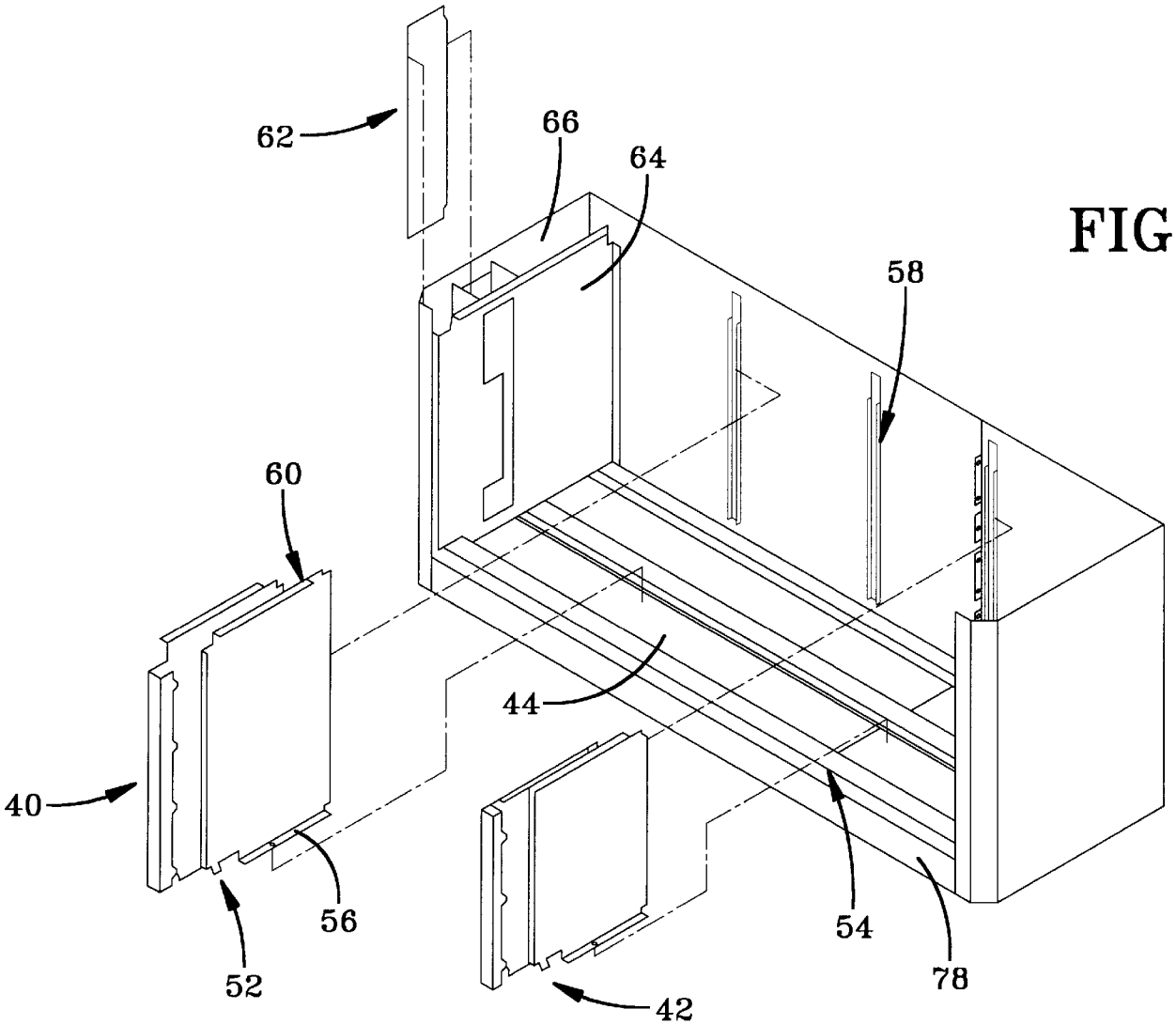
FIG. 3 illustrates one embodiment of the workstation with exploded views of the uprights.
Figure 4:
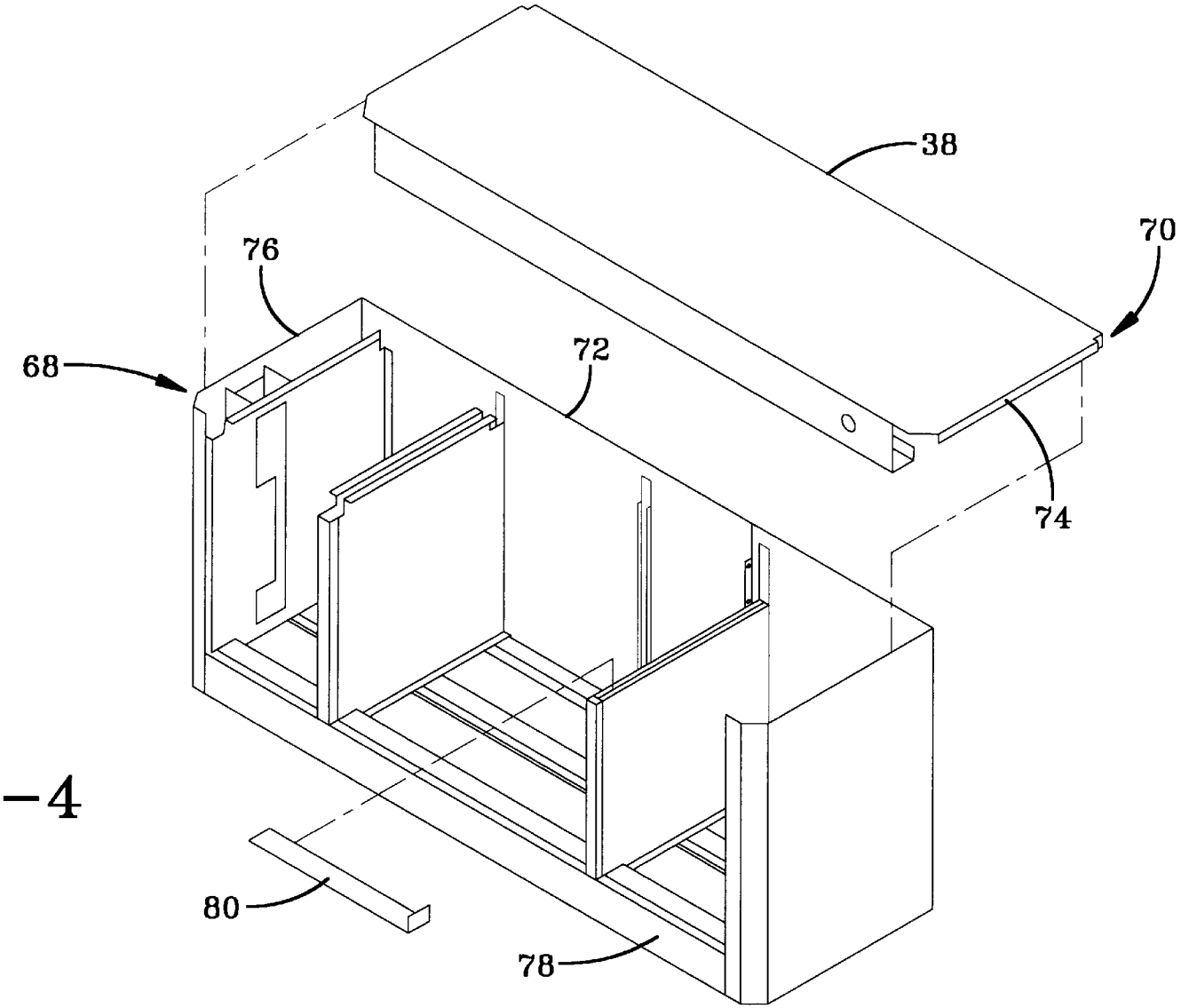
FIG. 4 illustrates one embodiment of the workstation with an exploded view of the top panel.

FIG. 2 illustrates an exploded view of the workstation 10. FIG. 3 illustrates one embodiment of the workstation 10 with exploded views of the uprights 40, 42 (the uprights 40, 42 may be of a one-piece or a multiple piece construction). FIG. 4 illustrates one embodiment of the workstation 10 with an exploded view of the top panel 38. In one embodiment, the workstation 10 of the present invention is comprised of:

a.) first module element 20 having a plurality of grooves 22, a back panel 24, a side panel portion 26, and a base;

b.) a second module element 28 having a plurality of grooves 30 corresponding to the grooves 22 of the first module element 20, a back panel 32, a side panel portion 34, and a base;

c.) a plurality of rails 36 inserted into the plurality of grooves 22, 30 of the first and second module elements 20, 28;

d.) a top panel 38 secured to the back panels 24, 32 and side panel portions 26, 34 of the first and second module elements 20, 28;

e.) first and second uprights 40, 42 attached to a base portion 44 formed by the connected first and second module elements 20, 28;

f.) a plurality of drawers 46; and g.) means for holding the plurality of drawers 46 attached in predetermined positions on the uprights 40, 42 and side panel portions 26, 34 of the first and second module elements 20, 28.

In an alternative embodiment, the back panels and side panel portions may be separate components from the base portion 44. Additionally, the back panels 20, 32 may also be comprised of a one-piece construction.

In the preferred embodiment, the first module element 20 is wider than the second module element 28. The corresponding edges 48 of the first and second module elements 20, 28 are secured together. The back panels 24, 32 of the first and second module elements 20, 28 are preferably attached using 3/16" poprivets 50. The resulting joint may be concealed using an adhesive backed black bumper molding. FIG. 3 illustrates the first and second module elements 20, 28 in an assembled state.

In the preferred embodiment, before the first and second module elements 20, 28 are attached, a plurality of rails 36 may be placed into the grooves 22, 30. Each rail 36 preferably contains multiple threaded holes for receiving bolts. These bolts secure the module elements 20, 28 to the rails 36 and also provide mounting points for the swivel and rigid casters 12. The rails 36 provide the necessary stiffness to the workstation 10 to ensure the workstation will not sag under heavy loads (i.e. from the drawers, top chest or side cabinets). The number of rails 36 placed in the workstation may vary depending on the width of the workstation 10 and the maximum load capacity. In the preferred embodiment the workstation 10 of the present invention has three rails 36.

Figure 5A:
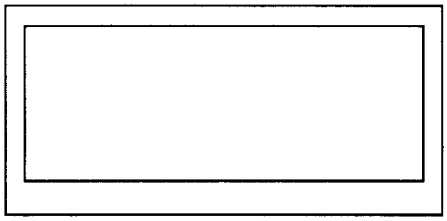
FIGS. 5A–5Q illustrate alternative upright and drawer configurations of the preferred embodiment of the present invention.
Figure 5B:
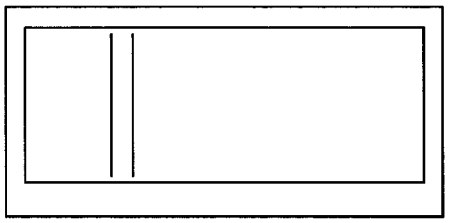
Figure 5C:
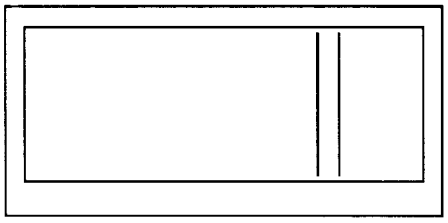
Figure 5D:
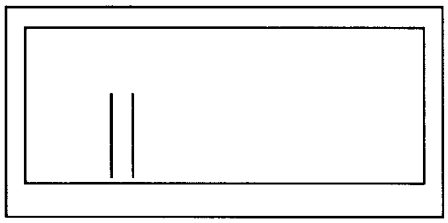
Figure 5E:
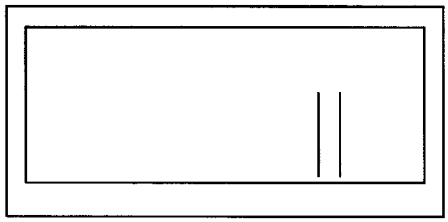
Figure 5F:
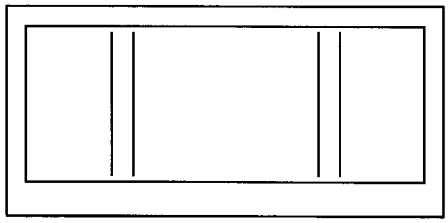
Figure 5G:
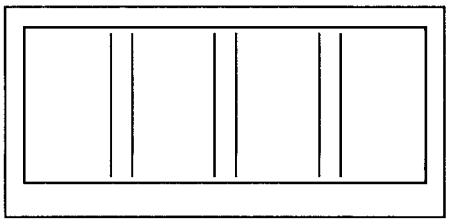
Figure 5H:
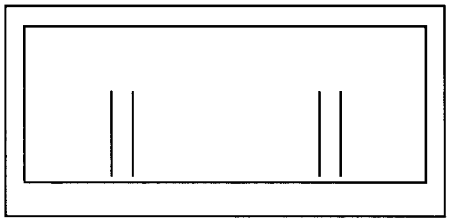
Figure 5I:
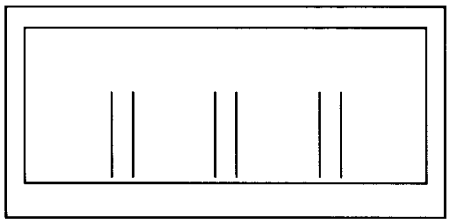
Figure 5J:
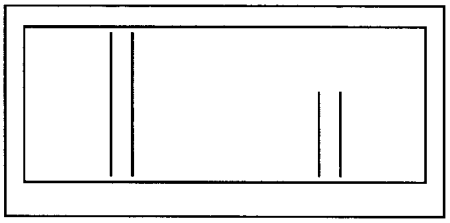
Figure 5K:
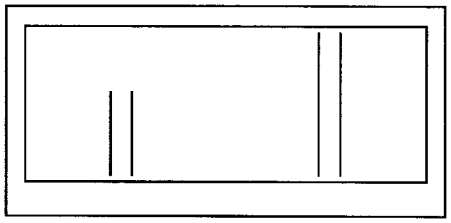
Figure 5L:
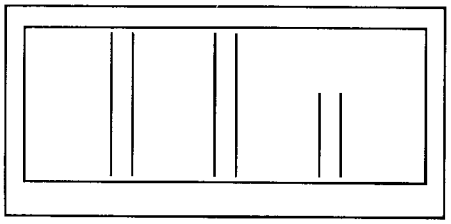
Figure 5M:
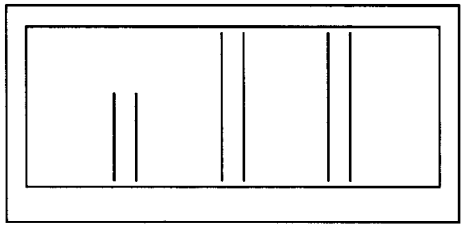
Figure 5N:
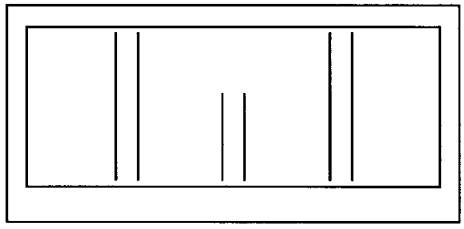
Figure 5O:
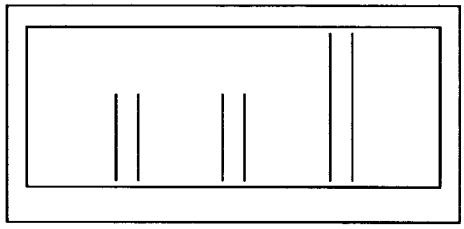
Figure 5P:
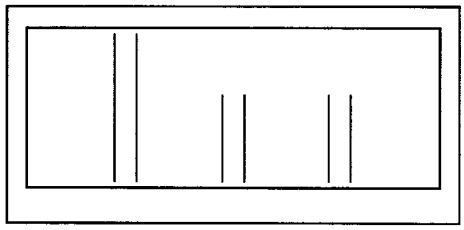
Figure 5Q:
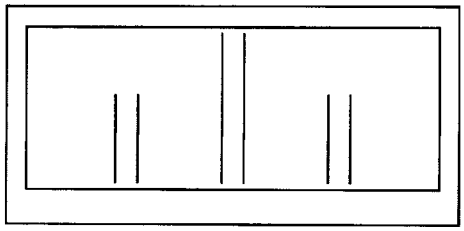

The uprights 40, 42 may be placed into the base portion 44 by, inserting the bottom tabs 52 of the uprights 40, 42 into the slots 54 in the base portion 44 of the workstation 10. These uprights 40, 42 may also be secured to the base portion 44 using screws along the bottom flanges 56 of the uprights 40, 42, the back flanges 58 of the back panel, and top flanges 60 located on the uprights 40, 42. The uprights 40, 42 may be "tall" uprights which extend all the way to the top panel 38 of the workstation 10 or they may be "short" uprights which do not extend to the top panel 38 of the workstation 10. The short uprights allow for the use of wider drawers 46. If a short upright is used, it is preferred that a upright strap 80 be installed on the short upright and a side panel. The upright strap 80 provides lateral support and prevents the top front corner portion of the upright 42 from displacing to die left and right. As discussed, in the preferred embodiment, either none, one, two, or three uprights may be used to accomplish various drawer configurations. FIGS. 5A–5Q illustrate elevational cross-sectional views of the workstation 10 of the preferred embodiment depicting various drawer configuration options of the workstation 10 the present invention.

In the preferred embodiment, it is preferred that the side panel portions 26, 34 be constructed of a double-wall construction. As illustrated in FIG. 3, a double-wall side panel 26, 34 is comprised of an inner and outer wall 64, 66. The double-wall side panels 26, 34 provide a space between the walls to allow for the securing of heavy duty drawer slide tracks 63.

For high load bearing applications, it is preferred that a corner reinforcer 62 be inserted into the space formed by the inner and outer walls 64, 66 of the side panels 26, 34. The corner reinforcement 62 is preferably held in position using sheet metal screws. The corner reinforcements 62 are vertical compression members that span from the top panel 38 to the base portion 44 of the workstation. The corner reinforcements 62 act to transfer top panel loads directly to the casters 12.

Referring to FIG. 4, in the preferred embodiment, bolts are inserted through clearance holes in the inner panel hat section 68 and hand threaded into a weld nut on the back side of the outer walls 66 (see areas identified as "A"). Subsequently, the top panel 38 may be secured to the workstation 10. It is preferred that the back edge of the top panel 38 contains an open hem flange 70 which hooks over the top edge 72 of the back panels 24, 32 of the first and second module elements 20, 28. The top panel 38 also preferably has side flanges 74 which are formed down and engage into wide pockets 76 running the depth of the outer wall 66. The overlapping of the top panel 38 and the outer wall 66, identified as Area "A", is clamped together by wrench tightening the bolts already in place in the clearance holes in the inner panel hat section 68. The resulting joint appears as a spot welded corner with no visible gap between the top panel 38 and the outer wall 66.

In the preferred embodiment, a facia strip 78 is secured to a front face of the base portion 44 of workstation 10, preferably using sheet metal screws. The facia strip 78 conceals the joint between the first and second module elements 20, 28 and also provides a skirt around the caster plate and mounting bolts.

The workstation 10 of the present invention is preferably constructed from a durable steel material. The top panel 38 is preferably a high strength panel able to accommodate large loads without lock system failure (i.e. 500 lb. minimum). In an alternative embodiment, a work surface, such as a laminated board may be placed on the top of the workstation 10.

Figure 6:
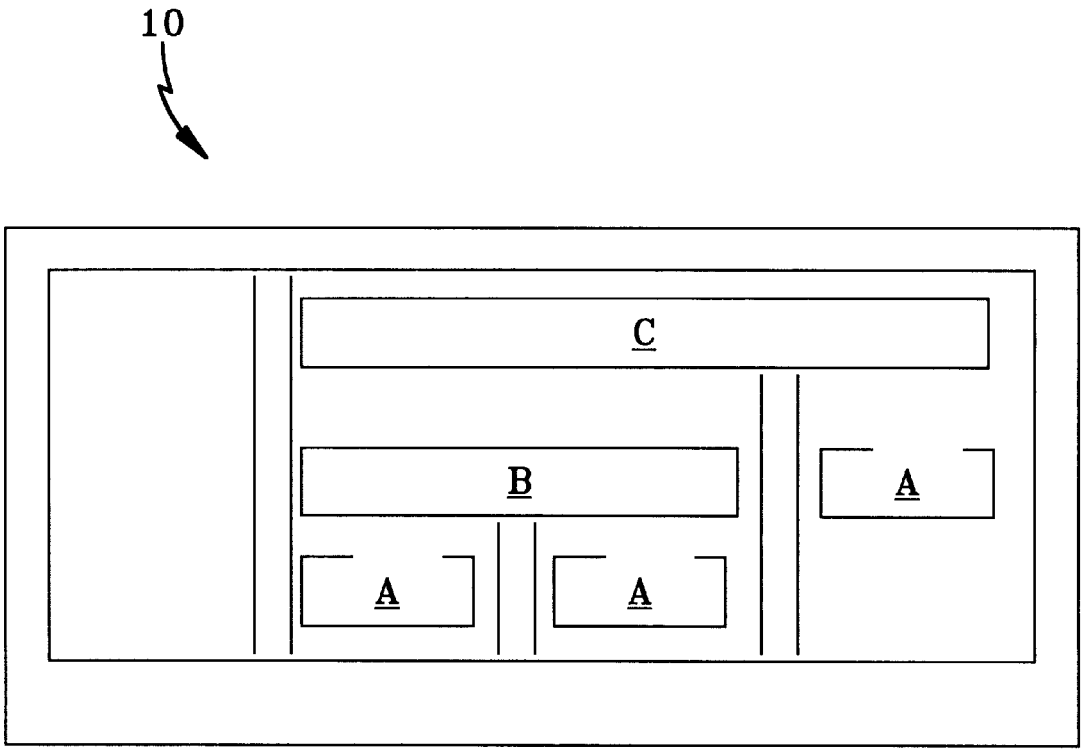
FIG. 6 illustrates an elevational cross-sectional view of one embodiment of the workstation.

The method of construction of the present invention provides modularity and drawer interchangeability. The uprights may be reversed, doubled-up, or eliminated to create many different drawer configurations. FIGS. 5A–5Q illustrate some of the possible drawer configurations. Depending on the upright configuration used, different width drawers can be mounted adjacent to each other. For example, looking at FIG. 6, two narrow width drawers (denoted as A) may be removed and replaced with a wider drawer (denoted as B). Three narrow or one narrow and one wide drawer may be removed and replaced with an extra wide drawer (denote as C).

Additionally, different width cabinet modules can be joined together to create unique workstation dimensions and drawer arrangements. For example, two wide module elements may be assembled to create a wider unit. The width of the modules are generally controlled by the dimension of the smallest standard width drawer for a given application.

As discussed, the workstation of the present invention provides the strategic value of custom drawer configurations within a given workstation size. Also, the method of construction, and the modularity of the preferred embodiment, offers the capability for infinite workstation sizes. Additionally, by building the modules separately, larger workstation widths are no longer limited by the dimensional capability of the paint and fabrication equipment. Workstations may be produced to larger sizes without demanding capital investments for new painting and sheet metal equipment adapted to larger one-piece welded.

Having shown and described a preferred embodiment of the invention, those skilled in the art will realize that many variations and modifications may be made to affect the described invention and still be within the scope of the claimed invention. Thus, many of the elements indicated above may be altered or replaced by different elements which will provide the same result and fall within the spirit of the claimed invention. For example, the number and placement of the uprights may vary, the size of the modules may vary, and the base portion of the invention may be a one-piece construction as opposed to being modular. It is the intention, therefore, to limit the invention only as indicated by the scope of the claims.

What is claimed is:

1. A heavy duty, large capacity workstation comprising:

a first module element comprising a base portion, a back panel and a side panel portion, said base portion having at least one groove and said side panel portion being of double-wall construction;

a second module element having a first groove corresponding to said groove of said first module element, comprising a base portion, a back panel, and a side panel portion, said base portion having at least one groove corresponding to said at least one groove of said first module element, said side panel portion being of double-wall construction, and wherein said first and second module elements are connected;

a first rail inserted into said at least one groove of said first and second module elements;

a top panel secured to said back panels and side panel portions of said first and second module elements;

a first upright attached to a base formed by said base portions of said connected first and second module elements; and at least one drawer slidably attached to said first upright;

wherein the width of said base is in excess of 60 inches.

2. A heavy duty, large capacity workstation comprising:

a first module element comprising a base portion, a back panel and a side panel portion, said base portion having at least one groove and said side panel portion being of double-wall construction;

a second module element having a first groove corresponding to said groove of said first module element, comprising a base portion, a back panel, and a side panel portion, said base portion having at least one groove corresponding to said at least one groove of said first module element, said side panel portion being of double-wall construction, and wherein said first and second module elements are connected;

a first rail inserted into said at least one groove of said first and second module elements;

a top panel secured to said back panels and side panel portions of said first and second module elements;

a first upright attached to a base formed by said base portions of said connected first and second module elements;

at least one drawer slidably attached to said first upright;

a first corner reinforcement vertically extending from said base to said top panel in a space formed by said double walls of said side panel portion of said first module element; and a second corner reinforcement vertically extending from said base to said top panel in a space formed by said double walls of said side panel portion of said second module element;

wherein the width of said base is in excess of 60 inches.

3. A heavy duty, large capacity modular workstation comprising:

a first module element having a first base portion, said base portion having at least one groove;

a second module element having a second base portion, said second base portion having at least one groove corresponding to said at least one groove of said first module element, said first module element and said second module element connected together along corresponding ends and forming a base;

a first rail inserted into said at least one groove of said first and second module elements;

a back panel attached to said base and generally perpendicular thereto;

a first side panel portion attached to one end of said base and generally perpendicular thereto, said first side panel portion of double-wall construction;

a second side panel portion attached to an opposite end of said base and generally perpendicular thereto, said second side panel portion of double-wall construction;

at least one array of slots in predetermined positions along said base;

at least one upright secured in said at least one array of slots; and at least one drawer slidably attached to said at least one upright;

wherein the width of said base is in excess of 60 inches.

* * * * *